United States Patent [19]

Bares

[11] Patent Number: 4,553,829

[45] Date of Patent: Nov. 19, 1985

[54] METERING BLADE FOR USE IN A DEVELOPMENT SYSTEM

[75] Inventor: Jan Bares, Webster, N.Y.

[73] Assignee: Xerox Corporation, Stamford, Conn.

[21] Appl. No.: 544,298

[22] Filed: Oct. 21, 1983

[51] Int. Cl.[4] ..... G03G 15/09

[52] U.S. Cl. ..... 355/3 DD; 118/657; 118/204; 118/261

[58] Field of Search ..... 355/3 DD, 3 R; 118/656–658, 261, 204

[56] References Cited

U.S. PATENT DOCUMENTS 4,226,524 10/1980 Hashimoto ..... 118/658 X
4,365,586 12/1982 Hosono et al. ..... 118/652
4,373,798 2/1983 Tsukada et al. ..... 355/3 DD
4,406,536 9/1983 Suzuki et al. ..... 118/658 X
4,436,412 3/1984 Yamagata et al. ..... 355/3 DD

*Primary Examiner*—R. L. Moses
*Attorney, Agent, or Firm*—H. Fleischer; J. E. Beck; R. Zibelli

[57] ABSTRACT

An apparatus in which a latent image recorded on an image receiving member is developed with marking particles. A developer roller transports the marking particles into the development zone. A blade having at least one aperture therein through which the marking particles pass has the free end portion thereof in contact with the developer roller. In this way, the thickness of the layer of marking particles on the developer roller is controlled.

14 Claims, 3 Drawing Figures

METERING BLADE FOR USE IN A DEVELOPMENT SYSTEM

This invention relates generally to an electrophotographic printing machine, and more particularly concerns an apparatus for developing a latent image recorded on a photoconductive surface.

Generally, the process of electrophotographic printing includes charging a photoconductive surface to a substantially uniform potential. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer material into contact therewith. This forms a toner powder image on the photoconductive surface. Subsequently, the toner powder image is transferred to a copy sheet. Finally, the powder image is heated to permanently affix it to the copy sheet in image configuration.

In the foregoing type of printing machine, a development system is employed to deposit developer material onto the photoconductive surface. Generally, the developer material comprises toner particles, which are mixed with coarser carrier granules. Typically, the toner particles are made from a thermoplastic material with the carrier granules being made from a ferromagnetic material. Alternatively, single component magnetic particles may be employed. A system utilizing single component magnetic developer material may be capable of high speeds. One type of development apparatus employing a single component magnetic material is described in U.S. Pat. No. 2,846,333 issued to Wilson in 1958. It has been found that when employing a single component developer material, it is highly desirable to meter a uniform layer of toner particles onto the developer material. Preferably, this layer of developer material is of a thin, controlled thickness. Uniform metering of a thin layer of toner particles, hereinbefore, placed stringent requirements on the mechanical design tolerances of the parts in the development system. In particular, it has been necessary to provide a uniform gap between the metering blade and the developer roller. This gap is of a very small width and the out of round condition of the developer roller relative to the positioning of the metering blade frequently introduced variations in the thickness of the layer of particles deposited thereon. Moreover, metering of a thin layer of particles onto the developer roller produced variations in the thickness of the layer due to the non-uniformity in the particles. Thus, it would be highly desirable to be capable of metering precise quantities of particles onto the developer roller without having to take into account the out of round condition of the developer roller or the impurities in the particles. Hereinbefore, various types of metering or doctor blades have been employed. The following disclosures appear to be relevant:

U.S. Pat. No. 4,365,586; patentee: Hosono et al.; issued: Dec. 28, 1982; U.S. Pat. No. 4,373,798; patentee: Tsukada et al.; issued: Feb. 15, 1983.

The relevant portions of the foregoing disclosures may be briefly summarized as follows:

Hosono et al. discloses a toner hopper disposed above a developer roller for dispensing toner particles thereon. The layer of the developer material formed on the developer roller is controlled by a doctor blade disposed in proximity to the surface of the developer roller. After termination of development, the developer material advances along the developer roller into contact with a developer removing blade. The developer removing blade has a plurality of rectangular spaced holes or openings therein through which the developer material passes.

Tsukada et al. discloses a toner hopper adapted to dispense developer material onto the surface of a developer roller. A doctor blade is positioned closely adjacent to the developer roller and regulates the thickness of the developer layer thereon. A reciprocally mounted shutter blade is positioned adjacent the doctor blade and adapted to move into contact with the developer material so as to clean the surface thereof.

In accordance with one aspect of the present invention, there is provided an apparatus for developing a latent image recorded on an image receiving member. The apparatus includes a housing defining a chamber for storing a supply of marking particles therein. Means transport the marking particles from the chamber in the housing closely adjacent to the latent image recorded on the image receiving member. Means are provided for controlling the thickness of the layer of marking particles on the transporting means. The controlling means has a free edge thereof contacting the transporting means and at least one aperture therein closely adjacent to the free edge through which a portion of the marking particles on the transporting means pass through prior to being transported closely adjacent to the latent image recorded on the receiving member.

Pursuant to another aspect of the present invention, there is provided an electrophotographic printing machine of the type having a photoconductive member arranged to have a latent image recorded thereon. The printing machine includes a housing defining a chamber for storing a supply of marking particles therein. Means transport the marking particles from the chamber in the housing closely adjacent to the latent image recorded on the photoconductive member. Means are provided for controlling the thickness of the layer of marking particles on the transporting means. The controlling means has a free edge thereof contacting the transporting means and at least one aperture therein closely adjacent to the free edge through which a portion of the marking particles on the transport means pass through prior to being transported closely adjacent to the latent image recorded on the photoconductive member.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
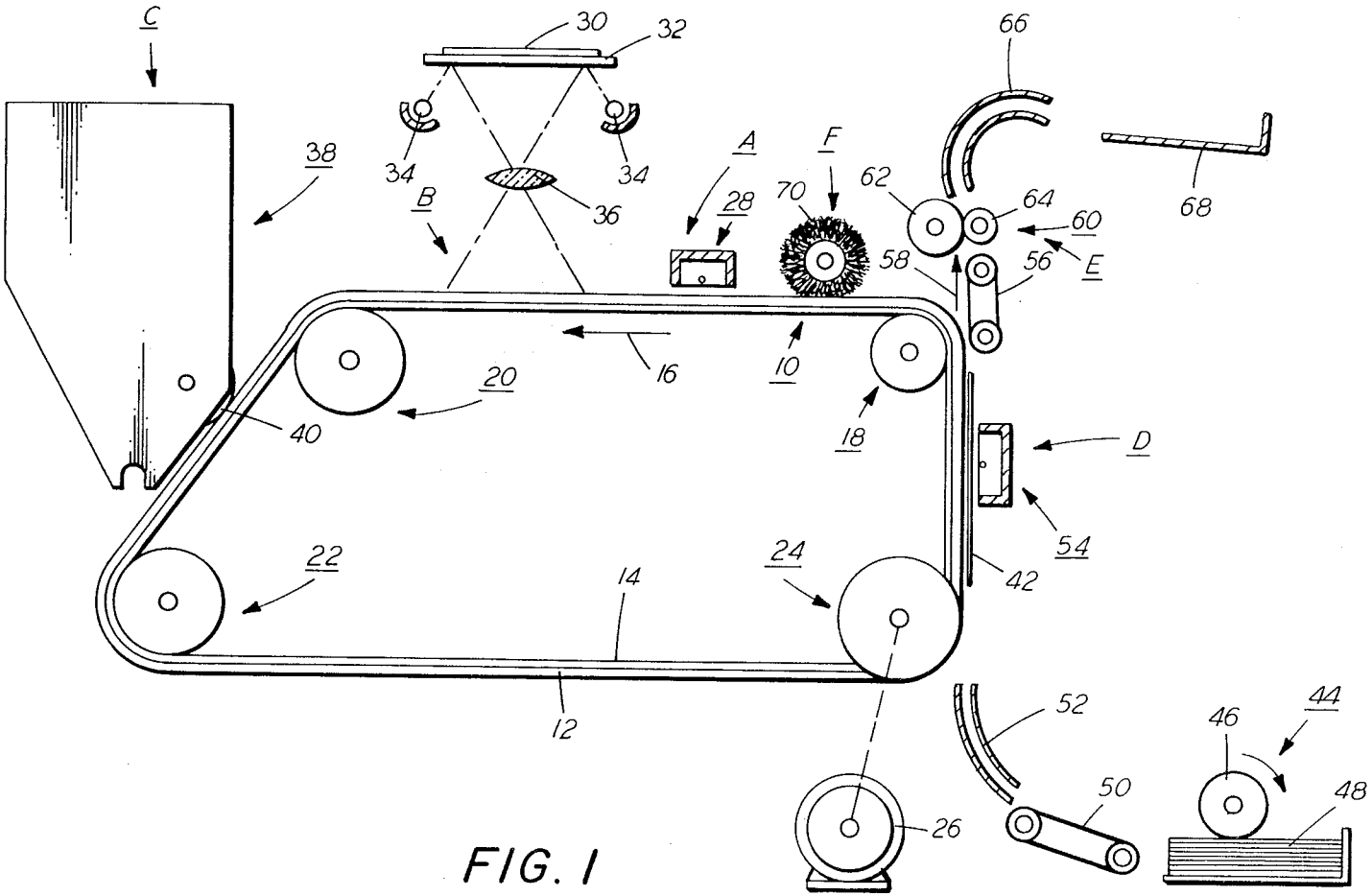
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this apparatus is equally well suited for use in a wide variety of electrostatographic printing machines and is not necessarily limited in its application to the particular embodiment depicted herein.

In the illustrative electrophotographic printing machine, as shown in FIG. 1, a belt 10 having a photoconductive surface 12 deposited on a conductive surface 14, moves in the direction of arrow 16. Preferably, the conductive substrate comprises a transparent support such as a poly (ethyleneterephthalate) cellulose acetate or other suitable photographic film supports, typically having coated thereon a transparent conductive coating such as high vacuum evaporated nickel, cuperous iodide or any suitable conducting polymer. The conductive support is, in turn, overcoated with a photoconductive layer typically comprising a binder and an organic photoconductor. A wide variety of organic photoconductors may be employed. For example, an organic amine photoconductor or a polyarylalkylene photoconductor may be used. However, one skilled in the art will appreciate that any suitable organic photoconductor compatible with the transparent conductive substrate may be utilized in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the marking particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20, idler roller 22 and drive roller 24. Drive roller 24 is mounted rotatably and in engagement with belt 10. Motor 26 rotates roller 24 to advance belt 10 in the direction of arrow 16. Roller 24 is coupled to motor 26 by suitable means such as a drive belt. Drive roller 24 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Stripping roller 18, tension roller 20 and idler roller 22 are mounted rotatably. These rollers are all idler rollers which rotate freely as belt 10 moves in the direction of arrow 16.

Initially, a portion of belt 10 passes through charging station A. At charging station A, a corona generating device, indicated generally by the reference numeral 28, charges photoconductive surface 12 of belt 10 to a relatively high, substantially uniform potential having a negative polarity. One skilled in the art will appreciate that the polarity of the charge imposed upon the photoconductive surface depends upon the selected photoconductor material and a suitable photoconductor material may be utilized wherein a positive polarity is applied rather than a negative polarity.

Next, the charged portion of photoconductive surface 12 advances through exposure station B. At exposure station B, an original document 30 is positioned facedown upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on the photoconductive surface having a negative polarity which corresponds to the informational areas contained within original document 30. Thereafter, belt 10 advances the electrostatic latent image recorded on photoconductive surface 12 to development station C.

At development station C, the magnetic brush development system of the present invention, indicated generally by the reference numeral 38, transports marking particles of a positive polarity into contact with the latent image recorded on photoconductive surface 12. The force exerted on the marking particles by the electrostatic image attracts the marking particles from developer roller 40 thereto. This forms a powder image on photoconductive surface 12 of belt 10 which corresponds to the informational areas contained within original document 30. The detailed structure of development system 38 will be described hereinafter with reference to FIGS. 2 and 3.

After development, belt 10 advances the powder image to transfer station D. At transfer station D, a sheet of support material 42 is moved into contact with the powder image. By way of example, the sheet of support material may be paper. The copy paper is advanced to transfer station D by a sheet feeding apparatus, indicated generally by the reference numeral 44. Preferably, sheet feeding apparatus 44 includes a feed roller 46 contacting the uppermost sheet of stack 48. Feed roller 46 rotates to advance the sheet from stack 48 onto conveyor 50. Conveyor 50 transports the sheet into chute 52 which guides sheet 42 into contact with photoconductive surface 12 of belt 10 in a timed sequence so that the powder image developed thereon contacts the advancing sheet 42 at transfer station D.

Transfer station D includes a corona generating device 54 which sprays negative ions onto the back side of sheet 42. In this way, sheet 42 is charged to a polarity opposite from that of the marking particles adhering to photoconductive surface 12 of belt 10. The powder image is attracted from photoconductive surface 12 to sheet 42.

After the marking particles have been transferred to sheet 42, conveyor 56 advances the sheet in the direction of arrow 58 to fusing station E. Fusing station E includes a fuser assembly, indicated generally by the reference numeral 60, which permanently affixes the transferred powder image to copy sheet 42. Preferably, fuser assembly 60 includes a heated fuser roll 62 and back-up roll 64. Sheet 42 passes between fuser roll 62 and back-up roll 64 with the powder image contacting fuser roller 62. In this manner, the powder image is permanently affixed to sheet 42. After fusing, chute 66 guides the advancing sheet to catch tray 68 for subsequent removal from the printing machine by the operator.

Invariably, after the copy sheet is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 70 in contact with photoconductive surface 12. The preclean corona generating device neutralizes the charge attracting the particles to the photoconductive surface. These particles are then cleaned from the photoconductive surface by the rotation of brush 70 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
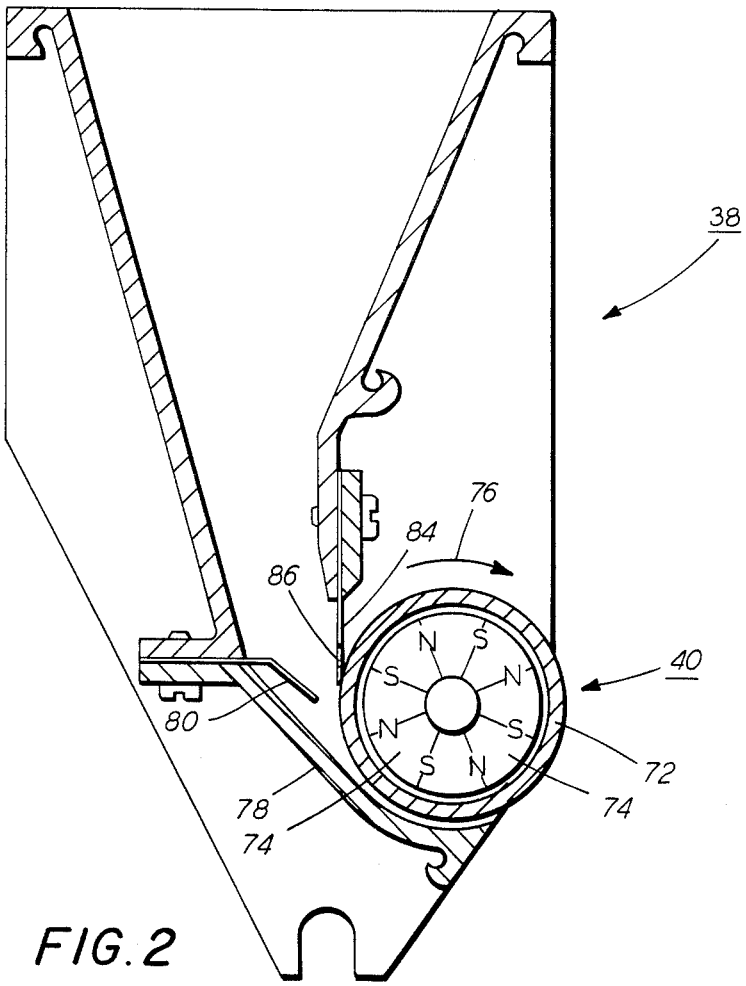
FIG. 2 is an elevational view showing schematically the development apparatus used in the FIG. 1 printing machine.

Referring now to FIG. 2, there is shown the features of the development apparatus of the present invention in greater detail. As depicted thereat, development apparatus 38 includes a developer roller, indicated generally by the reference numeral 40. Developer roller 40 incudes a nonmagnetic tubular member 72. Preferably, tubular member 72 is made from aluminum having a 0.15 millimeter thick layer of a polyvinylidene fluoride based material coated thereon. Tubular member 72 is interfit over magnetic member 74. Preferably, magnetic member 74 is made from barium ferrite in the form of a cylindrical member having twelve magnetic poles impressed about the circumferential surface thereof. The maximum radial magnetic field at the surface of magnet 74 is about 650 gauss. Tubular member 72 rotates at a tangential velocity ranging from about 16 centimeters per second to about 58 centimeters per second. Magnet 74 rotates at an angular velocity ranging from 1000 rpm to 1500 rpm. In this way, the marking particles move in the direction of arrow 76. Housing 78 stores a supply of marking particles in the chamber thereof. Initially, the marking particles advance beneath premetering blade 80. The free edge of blade 80 is spaced a distance ranging from 1 to 2 millimeters from the surface of tubular member 72. Preferably, metering blade 80 is made from sheet metal. After the layer of marking particles has passed through the gap between the free end of metering blade 80 and the surface of tubular member 72, blade 84 controls the resultant layer of marking particles advanced closely adjacent to the latent image recorded on photoconductive surface 12 of belt 10. The free end portion of blade 84 is resiliently urged into contact with the surface of tubular member 72. Blade 84 has a plurality of apertures 86 through which the marking particles pass. The size of apertures 86 controls the thickness of the layer of marking particles being advanced by developer roller 40 closely adjacent to the latent image recorded on photoconductive surface 12 of belt 10. Preferably, blade 84 is made from steel having a thickness of about 0.05 millimeters. The free end of blade 84 contacts the surface of tubular member 72 at an angle of about 15° with respect to a plane tangential to the surface and normal to a radius thereof. The detailed structure of blade 84 is depicted in FIG. 3.

Figure 3:
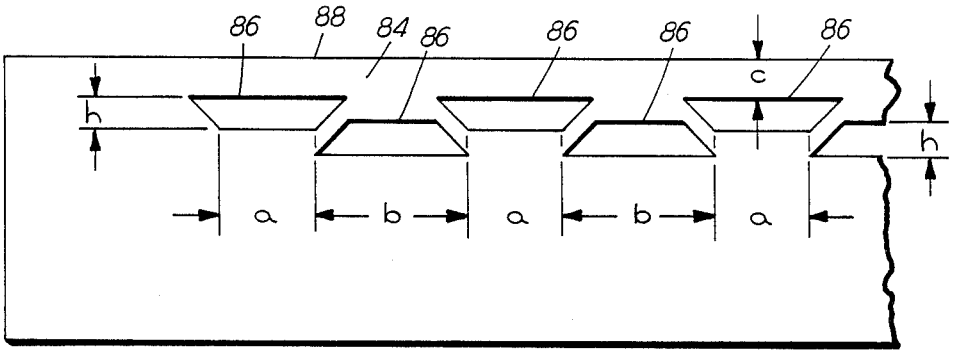
FIG. 3 is a fragmentary, plan view showing the metering blade employed in the FIG. 2 development system.

As shown in FIG. 3, apertures 86 are of a trapezoidal configuration extending across the width of blade 84. Two sets of interleafed trapezoidal apertures are utilized to form a uniform cross section extending across the width of tubular member 72. One set of trapezoidal apertures has the longer parallel side positioned closest to free end 88 of blade 84. The other set of trapezoidal apertures has the longer parallel side thereof positioned furthest from the free end 88 of blade 84. The sets of trapezoidal apertures are interleafed with one another to form a uniform cross section. Preferably, the height, h, of each trapezoid may range from 0.3 to 0.6 millimeters. The length of the shorter parallel side of each trapezoidal aperture, a, ranges from 1.0 to 2.0 millimeters. The length of the longer parallel side of each trapezoidal aperture, b, ranges from about 2.5 to 5.0 millimeters. The longer parallel side of the trapezoidal apertures closest to free end 88 of blade 84 is a distance, c, of about 1.0 millimeters therefrom. It should be noted that each trapezoidal aperture has the same dimensions with the dimensions preferably being selected from the preceding ranges. One skilled in the art will appreciate that the configuration of the aperture cross section is dependent upon the type of marking particles employed. The trapezoidal apertures heretofore described are preferably employed with marking particles comprising 40% by weight of magnetite, 59.5% by weight of a polymer resin and charge control agent, and 0.5% by weight of an aluminum oxide flow agent blended into the marking particles after fabrication. Marking particles with different flowability characteristics and different magnetic parameters may require differently shaped apertures in blade 84.

In recapitulation, the development apparatus of the present invention includes a developer roller for advancing a defined amount of marking particles closely adjacent to a latent image recorded on a photoconductive surface. A blade having the free end portion thereof in contact with developer roller and comprising a plurality of apertures therein regulates the thickness of the layer of marking particles on the developer roller. The marking particles advance from a storage chamber through the apertures in the blade into the development zone. In the development zone, the electrostatic latent image attracts a portion of the marking particles from the developer roller forming a powder image thereon. By utilizing a precisely controlled layer of marking particles on the developer roller, the resultant powder image formed on the photoconductive surface optimizes copy quality.

It is, therefore, evident that there has been provided in accordance with the present invention, an apparatus for developing an electrostatic latent image that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing a latent image recorded on an image receiving member, including:

a housing defining a chamber for storing a supply of marking particles therein;

means for transporting the marking particles from the chamber in said housing closely adjacent to the latent image recorded on the image receiving member; and a blade having at least two rows of apertures therein closely adjacent to the free edge thereof with the rows of apertures forming a substantially uniform cross section thereacross, said blade being attached to said housing with the free edge thereof being in resilient contact with said transporting means so that a portion of the marking particles on said transporting means pass through the apertures in said blade prior to being transported closely adjacent to the latent image recorded on the receiving member.

2. An apparatus for developing a latent image recorded on an image receiving member, including:

a housing defining a chamber for storing a supply of marking particles therein;

means for transporting the marking particles from the chamber in said housing closely adjacent to the latent image recorded on the image receiving member; and a blade having a plurality of substantially equally spaced apertures of a trapezoidal cross section therein closely adjacent to the free edge thereof, said blade being attached to said housing with the free edge thereof being in resilient contact with said transporting means so that a portion of the marking particles on said transporting means pass through the apertures in said blade prior to being transported closely adjacent to the latent image recorded on the receiving member.

3. An apparatus according to claim 2, wherein the apertures in said blade include at least two sets of equally spaced apertures, one set of apertures being positioned more closely to the free end of said blade than the other set of apertures.

4. An apparatus according to claim 3, wherein the sets of trapezoidal apertures are interleaved with one another with the longer parallel side of one set of trapezoidal apertures being spaced closest to the free edge of said blade and the longer parallel side of the other set of trapezoidal apertures being spaced furthest from the free edge of said blade.

5. An apparatus according to claim 4, wherein said transporting means includes:

a tubular member; and an elongated magnetic member disposed interiorly of and spaced from said tubular member.

6. An apparatus according to claim 5, wherein said tubular member is coated with a polyvinylidene fluoride based material.

7. An apparatus according to claim 6, wherein the free end of said blade contacts said tubular member at an angle of about 15 degrees with respect to a plane tangential to the surface and normal to a radius thereof.

8. An electrophotographic printing machine of the type having a photoconductive member arranged to have a latent image recorded thereon, wherein the improvement includes:

a housing defining a chamber for storing a supply of marking particles therein;

means for transporting the marking particles from the chamber in said housing closely adjacent to the latent image recorded on the photoconductive member; and a blade having at least two rows of apertures therein closely adjacent to the free edge thereof with the rows of apertures forming a substantially uniform cross section thereacross, said blade being attached to said housing with the free edge thereof being in resilient contact with said transporting means so that a portion of the marking particles on said transporting means pass through the apertures in said blade prior to being transported closely adjacent to the latent image recorded on the receiving member.

9. An electrophotographic printing machine of the type having a photoconductive member arranged to have a latent image recorded thereon, wherein the improvement includes:

a housing defining a chamber for storing a supply of marking particles therein;

means for transporting the marking particles from the chamber in said housing closely adjacent to the latent image recorded on the photoconductive member; and a blade having a plurality of substantially equally spaced apertures of a trapezoidal cross section therein closely adjacent to the free edge thereof, said blade being attached to said housing with the free edge thereof being in resilient contact with said transporting means so that a portion of the marking particles on said transporting means pass through the apertures in said blade prior to being transported closely adjacent to the latent image recorded on the receiving member.

10. A printing machine according to claim 9, wherein the apertures in said blade include at least two sets of equally spaced apertures, one set of apertures being positioned more closely to the free end of said blade than the other set of apertures.

11. A printing machine according to claim 10, wherein the sets of trapezoidal apertures are interleaved with one another with the longer parallel side of one set of trapezoidal apertures being spaced closest to the free edge of said blade and the longer parallel side of the other set of trapezoidal apertures being spaced furthest from the free edge of said blade.

12. A printing machine according to claim 11, wherein said transporting means includes:

a tubular member; and an elongated magnetic member disposed interiorly of and spaced from said tubular member.

13. A printing machine according to claim 12, wherein said tubular member is coated with a polyvinylidene fluoride based material.

14. A printing machine according to claim 13, wherein the free end of said blade contacts said tubular member at an angle of about 15 degrees with respect to a plane tangential to the surface and normal to the radius thereof.

* * * * *